US005222726A

United States Patent [19]

Vits

[11] Patent Number: 5,222,726

[45] Date of Patent: Jun. 29, 1993

[54] PROCESS AND DEVICE FOR SUSPENDED CONVEYING OF MATERIAL IN SHEETS OR BANDS OVER A CONVEYING PATH, IN PARTICULAR A CURVED CONVEYING PATH

[76] Inventor: Hilmar Vits, Huschelrath 16, D-5653 Leichlingen, Fed. Rep. of Germany

[21] Appl. No.: 585,136

[22] PCT Filed: Mar. 3, 1989

[86] PCT No.: PCT/EP89/00219

§ 371 Date: Oct. 22, 1990

§ 102(e) Date: Oct. 22, 1990

[87] PCT Pub. No.: WO89/09177

PCT Pub. Date: Oct. 5, 1989

[30] Foreign Application Priority Data

Apr. 2, 1988 [DE] Fed. Rep. of Germany ..... 3811264
Dec. 13, 1988 [DE] Fed. Rep. of Germany ..... 3841909

[51] Int. Cl.[5] ..... B65H 29/24

[52] U.S. Cl. ..... 271/195; 34/156; 226/97

[58] Field of Search ..... 34/156; 226/97; 406/88; 271/194, 195

[56] References Cited

U.S. PATENT DOCUMENTS

| | | | |
|---|---|---|---|
| 3,622,058 | 11/1971 | Vits | 34/156 |
| 3,680,223 | 8/1972 | Vits | 34/156 |
| 4,085,522 | 4/1978 | Stroszynski | 34/156 |
| 4,148,476 | 4/1979 | Brekell | 271/194 |
| 4,290,210 | 9/1981 | Johansson | 34/156 |
| 4,572,071 | 2/1986 | Cappel et al. | 271/195 |
| 4,804,125 | 2/1989 | Vits | 226/97 |
| 4,836,429 | 6/1989 | Nakashima et al. | 226/97 |
| 4,837,946 | 6/1989 | Hella et al. | 34/156 |
| 4,843,731 | 7/1989 | Vits | 226/97 |
| 4,848,633 | 7/1989 | Hagen et al. | 34/156 |
| 4,893,416 | 1/1990 | Vits | 34/156 |
| 5,016,363 | 5/1991 | Krieger | 34/156 |
| 5,028,173 | 7/1991 | Vits | 226/97 |

FOREIGN PATENT DOCUMENTS

| | | |
|---|---|---|
| 6939363 | 4/1974 | Fed. Rep. of Germany . |
| 3629720 | 4/1987 | Fed. Rep. of Germany . |
| 3607370 | 11/1987 | Fed. Rep. of Germany . |
| 3841909 | 9/1990 | Fed. Rep. of Germany . |
| 08950 | 11/1988 | World Int. Prop. O. . |

*Primary Examiner*—Robert P. Olszewski
*Assistant Examiner*—Steven M. Reiss
*Attorney, Agent, or Firm*—Marmorek, Guttman & Rubenstein

[57] ABSTRACT

The invention relates to a method and apparatus for the floatable guiding of material in the form of sheets or webs. The material in the form of sheets or webs (1*a*, 1*b*, 1*c*) is guided over floating nozzles disposed on one side and operating on the air cushion principle. Suction shafts are disposed between the individual floating nozzles, so that during conveying the material is alternately subjected to excess pressure and negative pressure forces, being guided as a result free from back-up and flapping in a required conveying plane. The invention is more particularly suited for guiding material over convexly and/or concavely curved conveying paths such as are usual, for example, for the dragging conveyance of printed sheets between the outlet of a printing machine and the delivery.

13 Claims, 3 Drawing Sheets

2
1a
8a
5
1b
2
2a
9a
8b
3
6
7
9
8a
4a
8b
10
3
7
1c
3
7
4 yF
yE
yB
+10
+5
0
-5
-10
+15
+10
+5
0
-5
+20
+15
+10
+5
±0
A
F
D
E
C
B
K
G
G
K
0
0,05
0,1
0,15
0,2

PROCESS AND DEVICE FOR SUSPENDED CONVEYING OF MATERIAL IN SHEETS OR BANDS OVER A CONVEYING PATH, IN PARTICULAR A CURVED CONVEYING PATH

In spite of the most varied devices for suspended conveying working on the principle of the air cushion or the supporting surface, the suspended conveying of material in sheets or bands is still a problem today, especially when thin material with a surface that is sensitive to contact has to be conveyed over paths with different curvatures. In sheet offset printing presses the speeds used today are such that the sheets are caused to flutter. The conveying time from press to storage is so short that the colorant oil cannot dry fast enough, especially with two-sided 4-color printing on smoothed and flattened paper so that smudging of the impression through contact due to fluttering is avoided. Conveying the sheets over aerated conveying surfaces is problematic because the centrifugal forces acting upon the sheet due of different curvatures of the conveying path vary. One-sided support of the sheets against air-cushion nozzles can therefore not prevent contact between sheets and conveying surfaces with certainty. Supporting-surface nozzles also cannot prevent contact because such nozzles blowing in the conveying direction push the sheets together and those blowing against the conveying direction increase the fluttering of the sheets.

In a known device for suspended conveying (DE-GM 60 30 363) the conveyed material is alternately supported on an air cushion and subjected to negative pressure. The device consists of a perforated nozzle body through which air is blown out to constitute air cushions and through which air is alternately aspired. In this manner a strict separation is ensured in conveying direction between zones in which the conveyed material is subjected exclusively to pressure forces and zones in which the conveyed material is subjected exclusively to suction forces. As a result, only material under band traction can be conveyed without contact by such a device. Sheets conveyed free would however be aspired at their forward and rear ends in those zones in which only suction forces take effect, so that contact would be unavoidable.

It is the object of the instant invention to create a device for suspended conveying of material in sheets of bands in which the material can be transported without fluttering and absolutely without contact even with the most varied curvatures of the conveying path.

The invention is based on a process for suspended conveying of material in sheets or bands over a conveying path in which the material is supported on one side on air cushions and is subjected to negative pressure between the air cushions. In this process the problem is solved in that the adjoining air cushions are constituted by free jets streaming past each other and crossing each other at sufficient intervals and in that the negative pressure is built up on the side of the material away from the free jets, said negative pressure reaching through the free jets.

The invention is furthermore based on a device for suspended conveying of material in sheets or bands over a conveying path made up of suspension nozzles supplied by blowing means and arranged at intervals between whose nozzle bodies and the material an overpressure in form of air cushions can be built up by the blowing means and between whose adjoining nozzle bodies means are provided for the production of a negative pressure acting upon the material. In such a device the problem is solved in that free-jet nozzles are formed in rows in the nozzle bodies at intervals and at a distance from the opposite nozzle bodies whereby the free-jet nozzles formed in one nozzle body are offset in direction of the row by approximately one half interval (distance between adjoining free-jet nozzles) in relation to the free-jet nozzles formed in the other nozzle body so that the free jets flow past each other and cross each other and in that suction shafts for the production of the negative pressure are provided between the nozzle bodies to build up the negative pressure acting on the material to produce the negative pressure against the material away from the free-jet nozzles.

In the instant invention the negative pressure superimposed on the overpressure and adjustable in strength makes it possible to maintain suction and pressure forces acting upon the material over the entire conveying path in such equilibrium that the material is conveyed in a desired plane without upsetting and without fluttering without any danger of contact between material and nozzle bodies. The constant alternation between pressure and suction forces has a favorable effect on stable conveying because it causes the material to assume the shape of a standing wave.

In the solution according to the instant invention known means for suspended conveying of material in form of free jets flowing past each other (DE-36 07 370 C1) are made use of to bring the negative pressure reaching through the free jets in this area into action on the material. The special advantage here is that a comparatively low volume of blown air suffices and that defined flow conditions are obtained for the blowing means flowing out of the air cushions.

If the material is conveyed over conveying paths with convex curvatures and conveying paths with concave curvatures, the negative pressure increases on conveying paths with convex curvature where conveying speed increases and decreases on conveying paths with concave curvature where conveying speed decreases.

The material is preferably conveyed by drag through traction forces attacking at its forward edge, as is customary with sheet offset printing presses. Since in the process according to the instant invention the material is not conveyed in a plane position over an aerated conveying surface but, because of the alternating subjection to overpressure and negative pressure, is conveyed in the form of a wave, the sheet end cannot flutter and/or reverse its corners. With material in a band the longitudinal folds occurring with the conventional process due to traction and affecting the quality of the finished product cannot form.

To produce the negative pressure without connecting all suction channels to one ventilator, the suction shafts are equipped with injectors. When conveying is around a curve, the injectors consist of a pipe which is fed blowing means and is provided with small nozzles at narrow intervals or they are fed inside the suction channel when conveying is straight, by a blowing means supply in common with the suspended nozzles.

In manner known with devices for the conveying of sheets imprinted in an offset printing pres to a storage area, the instant invention provides for driven rods with graspers extending across the conveying path by means of which the forward edge of the sheet can be grasped for the dragging conveying of the sheets.

Since the material is conveyed in its travel over the nozzle members over a very large number of very small free jets blowing in and contrary to the conveying direction, there is no resulting component of blowing medium flow in or contrary to the conveying direction. The air cushion effect includes the presence of the material over the nozzle member, the negative pressure effect including the presence of the material above the gap. The outermost end of the sheet covers these zones only alternately and incompletely, so that this end of the sheet is less satisfactorily guided and therefore tends to flap. To avoid this, according to one feature of the invention, further rods rotate between the rods having grippers, and all the rods have over their length blades whose turbulent zone extends as far as the next blade. This turbulent zone ensures that the differential speed as between the material and the blowing agent remains so low that the forces of buoyancy acting on the material can no longer cause flapping. This effect can be further improved if the conveying path is screened by a wall. An additional or alternative feature is that disposed above the conveying path are widely spaced-out nozzles fed with blowing agent, whose free jets blow flat onto the conveying plane in the conveying direction and produce a flow of blowing agent of lower speed than the conveying speed in the channel formed by the wall and the material.

An embodiment of the invention will now be described in greater detail with reference to the drawings, wherein.

Figure 1:
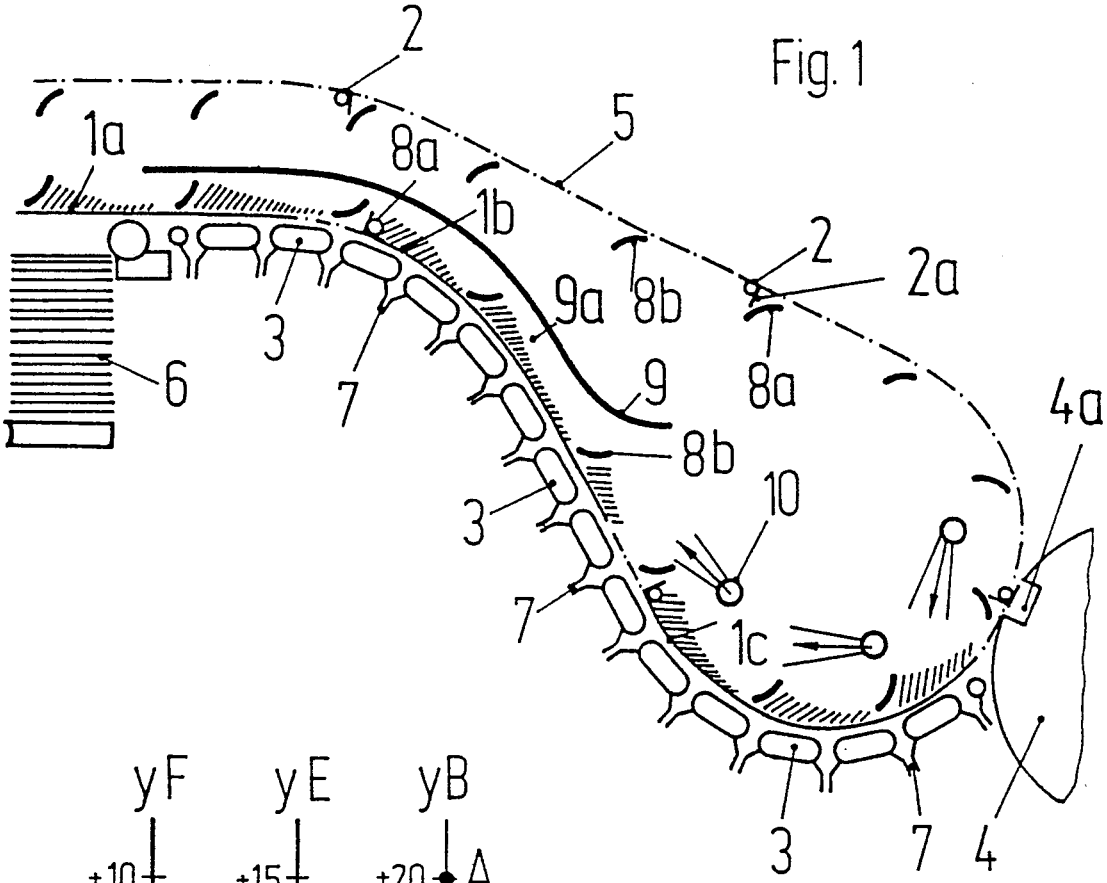
FIG. 1 is a diagrammatic side elevation of an apparatus for floatably conveying material in the form of sheets from a printing machine to a delivery.

Referring to FIG. 1, an S-shaped conveying path for printed sheets 1*a*, 1*b*, 1*c* is disposed between a take-over roller 4 of an offset printing machine and a delivery 6. For conveying the sheets 1*a*, 1*b*, 1*c* by dragging, a pair of rotating chains 5 is provided which are guided over guide elements (not shown) and bear rods 2 disposed transversely over the conveying direction and having a gripper elements 2*a* for seizing the start of a sheet. The speeds of the take-over roller 4 and the rods 2 having grippers 2*a* are so adapted to one another that the rods 2 meet a recess 4*a* in the take-over roller 4, to be able to seize the start of the sheet at that place without collisions. Blades 8*a* are attached to the rods 2 and blades 8*b* are provided on further rods (not shown) between the rods 2.

Figure 2:
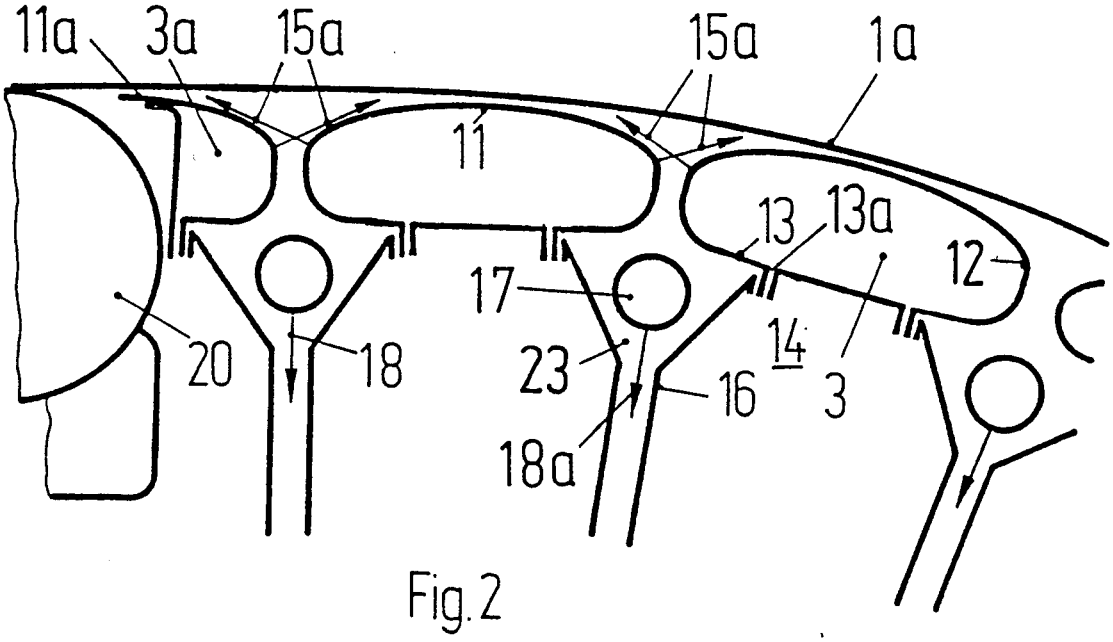
FIG. 2 is a side elevation showing an enlarged detail of the device shown in FIG. 1 immediately upstream of the delivery.
Figure 3:
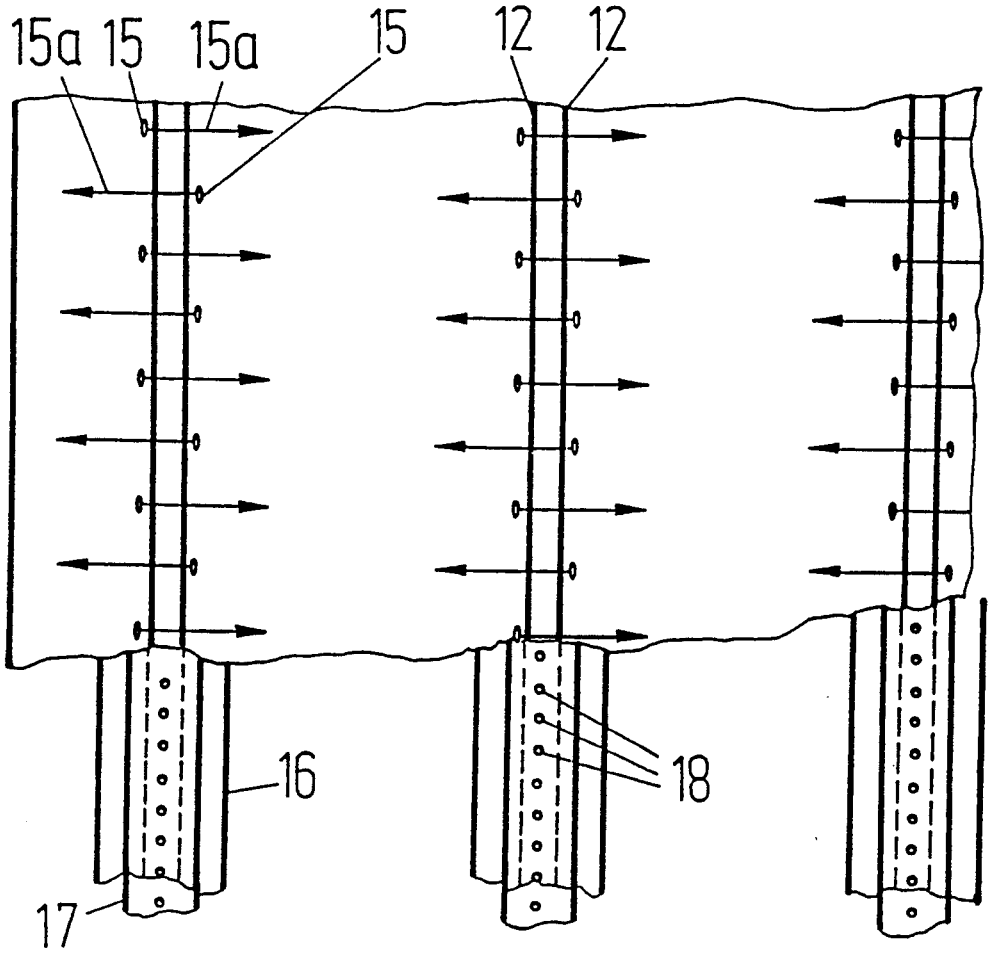
FIG. 3 is a plan view showing an enlarged detail of the apparatus shown in FIG. 1 immediately upstream of the delivery.

Disposed along the conveying path extending in S-shape on the printed underside of the sheets 1*a*, 1*b*, 1*c* are a plurality of blowing-medium-fed floating nozzles with nozzle boxes 3 and interposed suction shafts 7. As FIGS. 2 and 3 show, each nozzle member 3 takes the form of a hollow box and has on its side adjacent the conveying path a convexly bent back 11, at its edges transitions 12 in the form of arcs of a circle, and on the rear side an end 13 having inlets 13*a* via which the blowing agent enters the nozzle member 3. Disposed as nozzles in the transitions 12 in the shape of arcs of a circle are rows of holes 15 from which free jets 15*a* emerge. The holes 15 of adjacent nozzle members 3 are each offset by half a pitch, so that the free jets 15*a* pointing in the opposite directions flow past one another at a distance and impinge on the opposite curved back 11. The structure and aerodynamic function of such floating nozzles are known from German Patent 36 07 370.

The last nozzle member 3*a* in the conveying direction is only half constructed. Its short, convexly curved back 11*a* extends to close to a suction roller 20 disposed immediately upstream of the stack 6 of sheets and rotating in synchronization with the grippers 2*a*.

The gaps between the nozzle members 3, 3*a* form suction shafts 23. On the rear side of the nozzle members 3, 3*a* the suction shafts 23 are bounded by a wall 16 also bounding blowing medium supply means 14 from which the blowing medium is supplied via the inlets 13*a* to the nozzle boxes 3. To generate a negative pressure, disposed between the upwardly widening walls 16 are blowing tubes 17 whose blowing medium supply can be individually adjusted and from whose nozzle holes 18 on the injector principle jets 18*a* of blowing medium emerge and blow into the suction shafts 23. Due to the distances between the free jets 15*a*, the negative pressure can pass through the free jets 15*a* and become operative on the sheets 1, 1*a*, 1*b*, 1*c*.

Due to the free jets 15*a* directed at one another, the sheet 1*a*, 1*b*, 1*c* conveyed by dragging is subjected in the zone of the back 11 to an excess pressure and in the zone of the suctional shafts 23 to a negative pressure, so that the sheet is conveyed over the conveying path in the form of a standing wave. Due to the blades 8*a*, 8*b* conveyed with the sheet, on the side of the sheets 1*a*, 1*b*, 1*c* remote from the nozzle members 3 a turbulent zone shown in chain dot lines in FIG. 1 is formed which runs at the conveying speed and boosts guidance free from flapping. The smooth conveying is further boosted by the feature that a channel 9*a* is formed by a partition 9 disposed in the convex zone of the conveying path. In contrast, disposed in the concave zone of the conveying path are free jet nozzles which ensure that a blowing medium flow following the sheet is set up which also boosts the following flow in the channel 9*a*.

Figure 5:
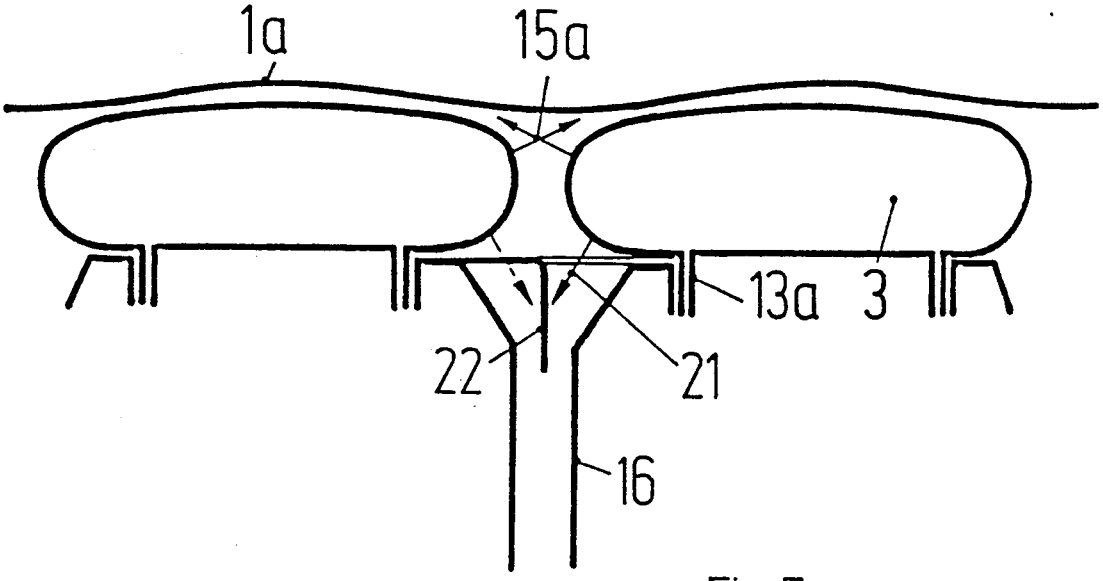
FIG. 5 is a side elevation of an enlarged detail of the apparatus shown in FIG. 1 in another embodiment in relation to FIGS. 2 and 3.
Figure 6:
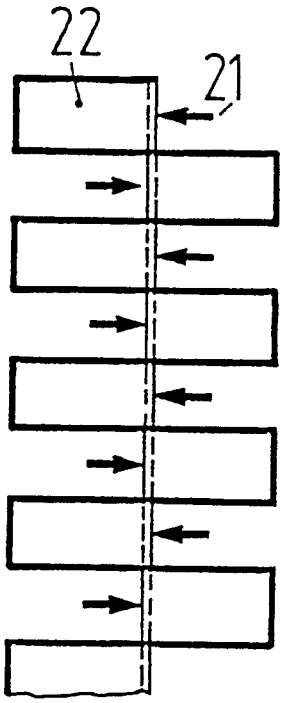
FIG. 6 is a front elevation showing a detail of the apparatus shown in FIG. 5.

The embodiment illustrated in FIGS. 5 and 6 differs from that shown in FIGS. 2 and 3 only by the feature that the negative pressure in the suction channels is produced not by the blown jets from special blowing tubes, but by blown jets 21 emerging from the nozzle members 3. To prevent the blown jets 21 from adjacent nozzle members from impeding one another as regards their injector effect, they are offset in relation to one another and screened from one another by separating plates 22. In that case the suctional force can be adjusted by varying the throttling of the nozzle holes for the injector jets 21.

Figure 4:
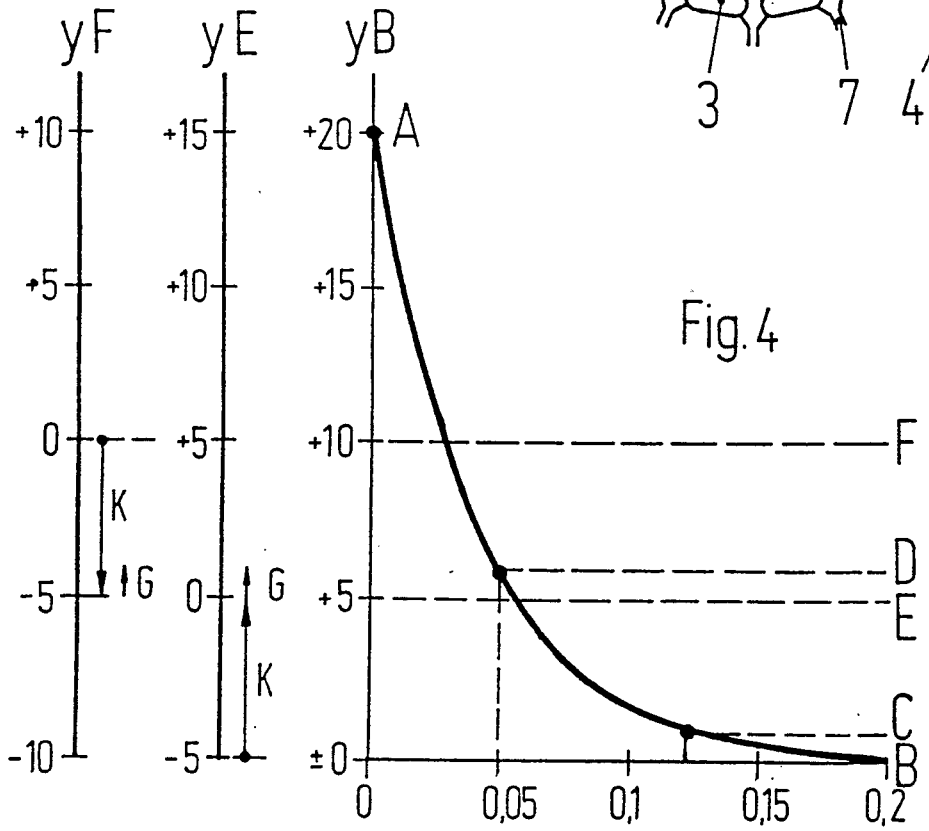
FIG. 4 is a graph of the supporting force in dependence on the distance of the material from the floating nozzles in the apparatus illustrated in FIG. 1.

The graph in FIG. 4 shows dimensionlessly the supporting force behaviour of the floating nozzles. The abscissa represents the distance of the material 1 from the back 11 of the floating nozzles, the ordinate representing their supporting force. The dimensionless distance is the ratio between the distance and the length of the back 11 of the floating nozzles in the conveying direction. The dimensionless supporting force is the ratio between the absolute supporting force in the zone of the back 11 and the product of the sum of the hydraulic hole cross-sections of the nozzles 15 and the pressure of the blowing jets 15*a* acting on the material.

The maximum supporting force at the point A is about 20. It must not be reached, since otherwise contact will take place. The maximum distance at the point B is 0.2. It is not reached, since no material is without weight. On a flat horizontal path, the supporting force O-C at the point DC corresponds to the weight G of the material. On a concave path the supporting force at the point D corresponds to the weight O-C of the material plus the centrifugal force C-D acting on it in accordance with the ordinate yB. To obtain the point D as the working point also on the straight part of the conveying path, where no centrifugal force is operative, a negative pressure having the value of the supporting force 5 must be superposed which is equal to the centrifugal force C-D at the point D. The supporting force curve remains unchanged, but in that case the abscissa lies at the level E and the ordinate yE is valid. In the convex part that centrifugal force must also be compensated which again corresponds to the supporting force 5, on the assumption of the same curvature as in the concave part. The abscissa with the level F and the ordinate yF applies to the convex part.

If now the working point D is required even when the machine starts, the negative pressure on the straight path is obtained unaltered in accordance with yE, on the concave path it is built up by the amount K, and on the convex path it is reduced by the amount K—i.e., at the start all the negative pressures are equal to 5 and the abscissa lies at E for all zones.

I claim:

1. A process for suspended conveying of material in sheets over a curved conveying path, comprising supporting said sheets by producing oppositely directed free jets which are spaced apart from each other in a direction which is transverse to a conveying direction of said conveying path and impinge on one side of said sheets thereby producing air cushions which support said sheets, and producing suction between pairs of said oppositely directed free jets thereby producing zones of negative pressure which reach through said air cushions and stabilize said sheets.

2. The process of claim 1 wherein said conveying path includes at least one section of convex curvature.

3. The process of claim 1 wherein said conveying path includes at least one section of concave curvature.

4. The process of claim 1 wherein said conveying path includes at least one section of convex curvature and at least one section of concave curvature, wherein increased suction is produced in said section of convex curvature so that a conveying speed of said sheets increases, and wherein said decreased suction is produced in said section of concave curvature and said conveying speed is decreased.

5. Device for suspended conveying of material in sheets along a conveying path, comprising means for producing a jet of air including a plurality of blowing nozzles arranged below said conveying path, said blowing nozzles being grouped in pairs of rows extending transversely to a conveying direction of said conveying path, said blowing nozzles in a first row being oppositely directed and offset in said transverse direction from said blowing nozzles in a second row of said pairs of rows, thereby producing oppositely directed and spaced apart free jets which cross each other at a distance and support said sheets on air cushions, and means for creating s suction including suction shafts disposed between said blowing nozzles of said first and second rows of each of said pairs of rows which produce regions of suction between said oppositely directed free jets.

6. The device of claim 5 wherein said suction shafts are offset from each other by one half of a spacing interval.

7. The device of claim 6 wherein the suction produced by said suction shafts is adjustable.

8. The device of claim 7 wherein said suction shafts include injectors distributed over their lengths.

9. The device of claim 8 wherein said injectors are connected to said blowing nozzles.

10. The device of claim 9 wherein said injectors and said blowing nozzles share a common blowing supply.

11. The device of claim 5 further comprising graspers for grasping a forward edge of said sheets, said graspers being driven by driving rods.

12. The device of claim 11 further comprising a partition wall disposed along said conveying path on a side of said sheets away from said air cushions.

13. The device of claim 12 further comprising a set of blowing nozzles disposed above said conveying path at large intervals which produce crossing free jets that blow flatly upon said conveying path in said conveying direction and produce in a channel between said partition wall and said sheets a stream of air which is slower than a conveying speed of said sheets.

* * * * *